United States Patent [19]

Reinhardt et al.

[11] 4,261,471

[45] Apr. 14, 1981

[54] FABRICATED BACKSTOP FOR RAILWAY CARS

[75] Inventors: James R. Reinhardt; Mark P. Scott, both of Houston, Tex.

[73] Assignee: ACF Industries, Incorporated, New York, N.Y.

[21] Appl. No.: 968,323

[22] Filed: Dec. 11, 1978

[51] Int. Cl.[3] ..... B61G 9/22

[52] U.S. Cl. ..... 213/10; 213/43; 213/58

[58] Field of Search ..... 213/7, 10, 43, 51, 58

[56] References Cited

U.S. PATENT DOCUMENTS

| | | | |
|---|---|---|---|
| 3,232,443 | 2/1966 | Smith | 213/43 |
| 3,515,286 | 6/1970 | Powell | 213/43 |
| 3,589,528 | 6/1971 | Stephenson | 213/43 |
| 3,854,596 | 12/1974 | Stephenson et al. | 213/43 |
| 3,907,121 | 9/1975 | Carle et al. | 213/43 |
| 3,910,418 | 10/1975 | Hawthorne | 213/43 |
| 3,917,075 | 11/1975 | Knippel | 213/43 |
| 4,146,142 | 3/1979 | Bomgardner et al. | 213/10 |
| 4,159,777 | 7/1979 | Howe Jr. | 213/10 |

*Primary Examiner*—John J. Love
*Assistant Examiner*—Ross Weaver
*Attorney, Agent, or Firm*—Eugene N. Riddle

[57] ABSTRACT

A fabricated backstop for an end-of car cushioning unit in a railway car. The backstop is composed of two plate members or pieces which are welded separately to the inside of a center sill. One backstop piece is a generally U-shaped vertical plate member which is welded about its entire outer circumference to the inside of the center sill and provides an over-solid stop. The second backstop piece is a horizontal plate member positioned in contact with the rear face of the vertical plate member and having a cutout portion to receive an end collar of an end-of-car cushioning device. The horizontal plate member is welded at its front face to the vertical plate member and at its outer sides to the center sill to provide a rear buff stop and a rear draft stop.

4 Claims, 6 Drawing Figures

26
22
24
18
28
18
20
20
32
32
36
38
14
12
12
14
37
40
10
46
42
48
44

26
22
24
18
18
20
20
28
30
32
34
36
14
14
12
12
46
40
42
10
48

FABRICATED BACKSTOP FOR RAILWAY CARS

BACKGROUND OF THE INVENTION

Heretofore, such as shown in U.S. Pat. No. 3,515,286 dated June 2, 1970 to R. G. Powell, and U.S. Pat. No. 4,040,523 dated Aug. 9, 1977 to R. G. Carle et al, backstops have been welded to the center sill and adapted to receive an end-of-care cushioning unit. The backstops heretofore have been utilized as an over-solid buff stop, a draft stop and a buff stop. However, the backstop structures heretofore have been formed of castings or several members first welded together and then welded to the center sill.

DESCRIPTION OF PRESENT INVENTION

The present invention is directed to a backstop for an end-of-car cushioning unit formed of two separate pieces or plate members which are welded separately to the inside of the center sill. One of the pieces is a vertical plate member extending transversely of the center sill between the sides thereof and being of a generally U-shape. The vertical plate member is welded along its front and rear faces to the opposed sides and upper cover plate of the center sill. The other piece is a horizontal plate member extending transversely of the center sill between the sides thereof and positioned adjacent and in contacting relation to the rear face of the vertical plate member to form a rear buff stop and a rear draft stop. The horizontal plate member is welded to the sides of the center sill and to the rear face of the vertical plate member, and has a slot therein which is adapted to receive the end cap or collar of an end-of-car cushioning device. The vertical plate member provides the over-solid buff stop by its direct connection to the sill as well as its support from the horizontal plate member. The two plate members which form the fabricated backstop are welded separately within the center sill.

The backstop structure is designed to withstand a maximum load at the over-solid buff stop of around 1,250,000 pounds. Under normal operating conditions, buff loads are of a maximum of around 700,000 pounds and draft loads are of a maximum of around 450,000 pounds. The weld connections must be adequate to transmit such loads to the center sill and can be increased by a lengthening of the horizontal plate member. If desired, however, to have the horizontal plate member of a relatively short length, then slots may be arranged in the side sills to permit welding of the horizontal plate member from a location outside the side sill thereby to provide an increased weld connection for transmitting the maximum buff loads to the center sill.

Figure 1:
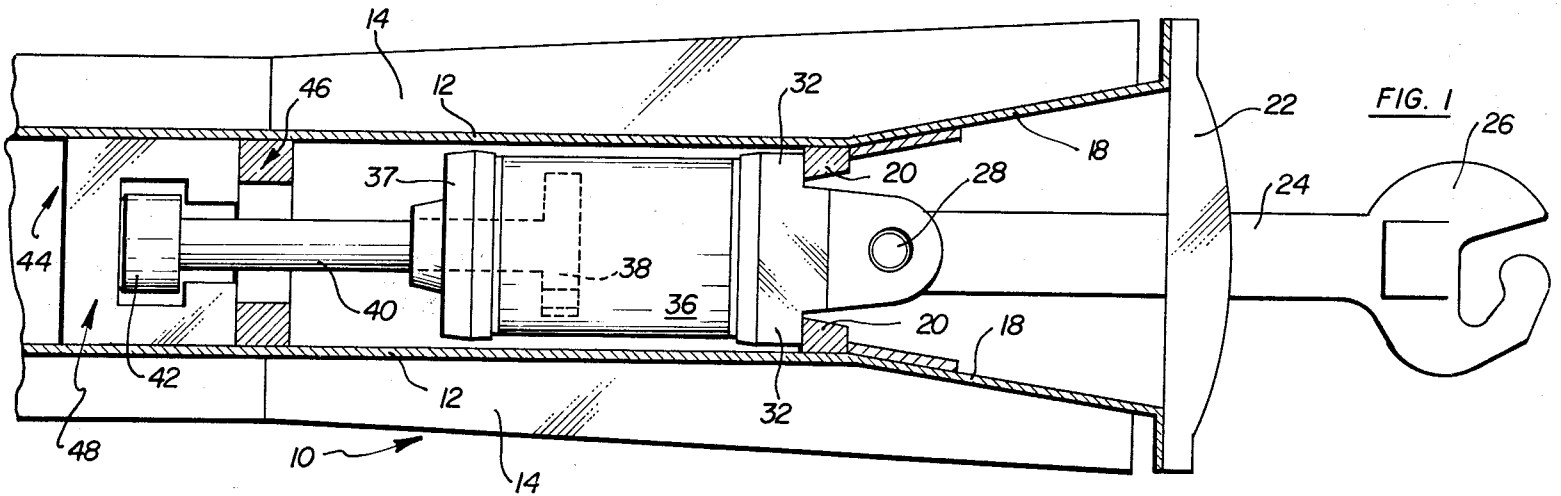
FIG. 1 is a fragmentary plan view of the center sill structure of a railway car illustrating the end-of-car cushioning unit in a neutral fully extended position.

Referring now to the drawings for a better understanding of this invention, a center sill is shown at 10 and includes spaced sides or webs 12 having lower outwardly extending flanges 14. A top cover plate 16 extends between sides 12 to form a generally hat-shaped center sill 10. The outer ends of center sill 10 are flared at 18. Front draft lugs 20 are secured to the inside of sides 12 by welding. A striker 22 extends between the outwardly flared sides 18 of center sill 10. Mounted within center sill 10 is a coupler having a shank 24 and a coupler head 26. Shank 24 is pivotally connected at 28 to a yoke 30 which forms the front end cap 32 of an end-of-car cushioning device generally indicated at 34. End cap 32 is adapted to engage front draft lugs 20 in the fully extended neutral position of cushioning unit 34. Cushioning unit 34 comprises an outer cylinder 36 having a rear end cap 37 and a piston 38 mounted in cylinder 36 for reciprocal movement. A piston rod 40 secured to piston 38 has an enlarged end collar 42 thereon. Cushion unit 34 is of the type generally shown in the aforementioned U.S. Pat. No. 4,040,523 dated Aug. 9, 1977 and entitled "Railway Car Cushioning Device". Piston 38 contains valving which meters the flow of fluid from a high pressure chamber on one side of piston 38 to a low pressure chamber on the other side of piston 38 upon impacts exerted against coupler 26 as explained in U.S. Pat. No. 4,040,523.

The backstop structure forming the present invention is indicated generally by the numeral 44. Backstop structure 44 comprises two separate plate members, one plate member with respect to the railway car structure being a vertically extending plate member indicated generally at 46 and the other plate member being a generally horizontal plate member indicated generally at 48. Vertical plate member 46 is generally U-shaped and has a cutout portion forming a slot 50 to receive piston rod 40 of cushioning unit 34 therein. Vertical plate member 46 is positioned within center sill 10 from the bottom side thereof and a front face 52 of vertical plate member 46 is secured by weld 54 about the entire outer periphery of front face 52 to sides 12 and upper cover plate 16. Rear face 56 of vertical plate member 46 is welded about its entire outer periphery by weld 58 to sides 12 and upper cover plate 16. The lower edge surface of vertical plate member 46 adjacent the center sill is welded at 60 to sides 12.

After the welding of vertical plate member 46 to the interior of center sill 10, horizontal plate member 48 is then inserted within the center sill 10 between sides 12 from the open portion of center sill 10. Horizontal plate member 48 has a slot with an enlarged width portion or pocket 62 adapted to receive end collar 42 of cushion unit 34 and a small width portion or pocket 64 which receives piston rod 40. Inner rear surface 66 defining enlarged width portion 62 is in contact with the adjacent end surface of end collar 42 and forms the rear buff stop surface. Spaced surface or shoulder 68 engage the adjacent surface of end collar 42 when draft loads are applied to cushion unit 34 when cushion unit 34 is in a retracted position and forms a rear draft stop. Horizontal plate member 48 is positioned adjacent rear face 56 of vertical plate member 46 and is welded along welds 70 to the adjacent sides 12 of center sill 10. The rear surface 72 of horizontal plate member 48 between upper surface 74 and lower surface 76 is welded at 80 to the adjacent sides 12 of center sill 10. A front surface of horizontal plate member 48 indicated at 82 is in opposed facing contact with rear surface 56 of vertical plate member 46 and is welded along welds 84 to the inner periphery of slot 50 in vertical plate member 46. Also, lower surface 76 is welded along welds 86 to the adjacent rear face 56 of vertical plate member 46.

To provide additional weld connections to center sill 10 without increasing the length of horizontal plate member 48 an additional weld surface can be provided by adding elongated slots 88 in sides 12 adjacent horizontal plate member 48. Welds 90 about the circumference of elongated slots 88 provide additional weld connections to transfer the maximum buff loads to center sill 10 from the end-of-car cushioning unit 34. The elongated slots 88 are positioned very close to the horizontal neutral axis of center sill 10 so that sides 12 are weakened only a minimum amount by slots 88.

Figure 2:
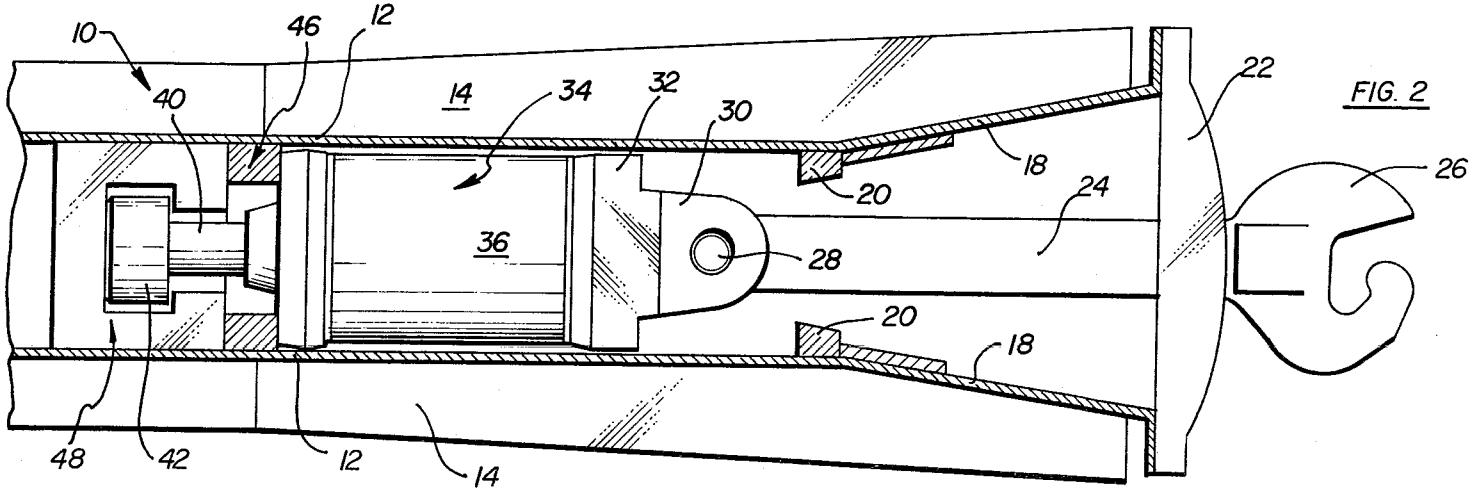
FIG. 2 is a plan view of the center sill structure shown in FIG. 1 with the end-of-car cushioning unit shown in a full buff position in engagement with the over-solid stop formed by the vertical plate member of the rear stop structure.
Figures 3, 4, 5, 6:
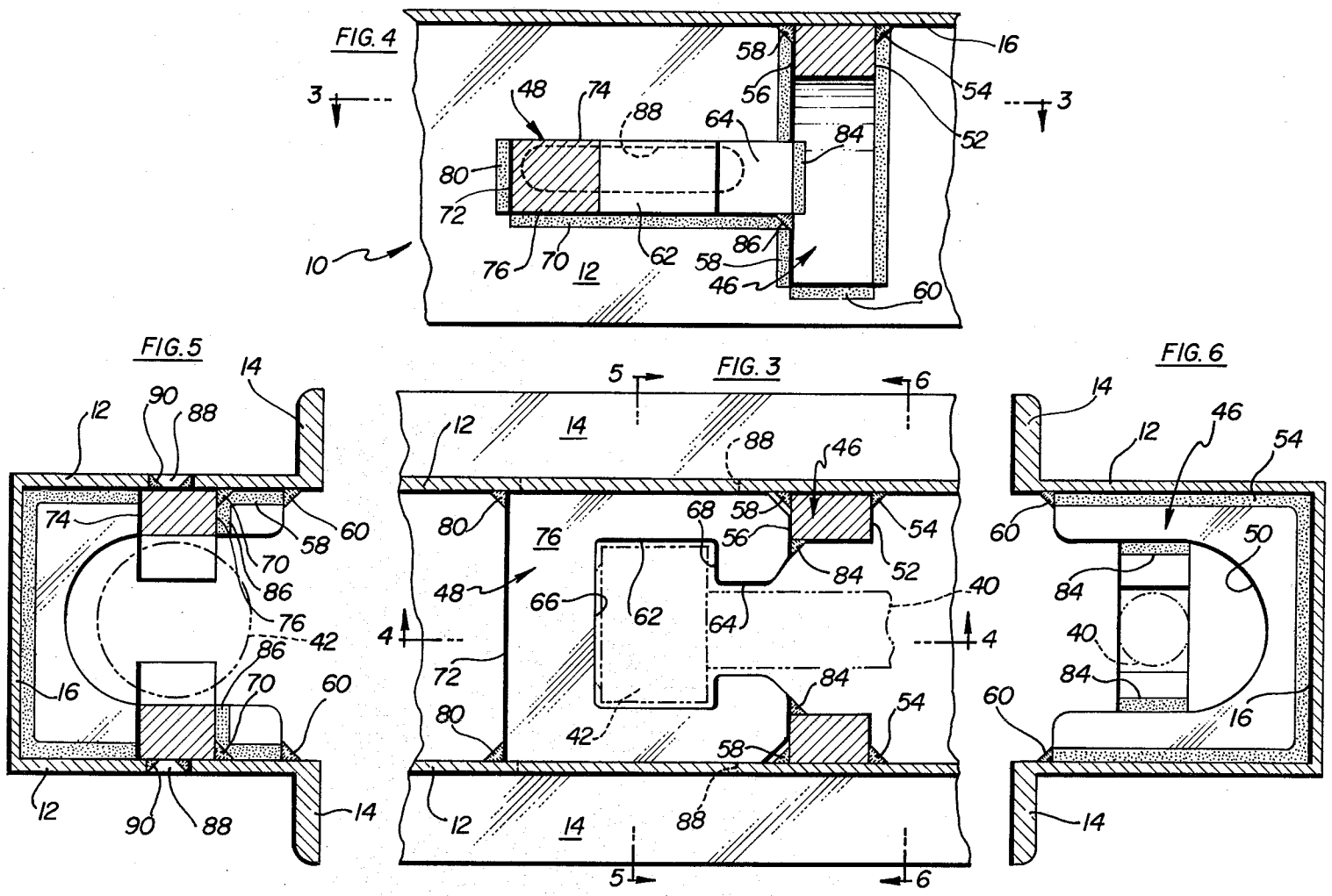
FIG. 3 is a section taken generally along line 3—3 of FIG. 4 and showing the backstop structure positioned within the center sill structure.
FIG. 4 is a section generally taken along line 4—4 of FIG. 3.
FIG. 5 is a section taken generally along line 5—5 of FIG. 3.
FIG. 6 is a section taken generally along line 6—6 of FIG. 3.

In operation, upon buff loads being exerted against coupler 26, cushioning unit 34 is moved to a retracted position for absorbing the impact loads through the metering of fluid through piston 38. Initial impact buff loads are transmitted through end collar 42 to horizontal plate member 48, hence to center sill 10. At the full buff travel position end cap 37 abuts the over-solid stop formed by front face 52 of vertical plate member 46 as shown in FIG. 2, and buff loads will be transmitted through vertical plate member 46 and horizontal plate member 48 to center sill 10. Draft loads from the fully extended position shown in FIG. 1 are transmitted to draft lugs 20 and center sill 10. Draft loads when cushioning unit 34 is in a retracted position are transmitted by end collar 42 through spaced shoulders 68 of horizontal plate member 48.

A rear stop structure has been provided by the present invention which comprises two plate members that are welded to the center sill. One plate member is a front vertical plate member and the other plate member is a horizontal rear plate member positioned in contact with the rear face of the vertical plate member. The plate members are easily welded in position within the inside of the center sill and adequate weld connections are made to the center sill to transmit the buff and draft loads.

What is claimed is:

1. A fabricated two piece backstop structure mounted within a center sill to receive the rear end of an end-of car railway cushioning device comprising:

a vertical plate member forming one piece extending transversely of the center sill between the sides thereof and being generally U-shaped to define a slot therein, the vertical plate member being welded along its front and rear faces to the opposed sides and upper cover plate of the center sill;

and a horizontal plate member forming the other piece extending transversely of the center sill between the sides thereof positioned adjacent and in contacting relation to the rear face of the vertical plate member, said horizontal plate member being welded to the sides of the center sill and to the rear face of the vertical plate member, said horizontal plate member having a slot therein defining a large width rear portion and a small width front portion, said large width rear portion defining opposed rear and front surfaces adapted to receive the enlarged rear end of an end-of-car cushioning device therebetween, said vertical plate member adapted to provide an over-solid rear buff stop and said opposed rear and front surfaces adapted to provide a rear buff stop and a rear draft stop respectively.

2. The backstop stucture as set forth in claim 1 wherein said horizontal plate member is welded to the rear face of the vertical plate member at the slot in the vertical plate member.

3. In a railway car having a center sill, an end-of-car cushioning device mounted within an end of the center sill having a cylinder and a piston rod extending rearwardly from the cylinder, the piston rod having an enlarged end collar at its rear end, and a coupler connected to the front end of the cylinder; an improved backstop structure for the cushioning device mounted within the center sill, said backstop structure being a fabricated two piece structure comprising:

a vertical plate member forming one piece extending transversely of the center sill between the sides thereof and being generally U-shaped to define a slot therein, the vertical plate member being welded along its front and rear faces to the opposed sides and upper cover plate of the center sill;

and a horizontal plate member forming the other piece extending transversely of the center sill between the sides thereof positioned in contacting relation welded to the rear face of the vertical plate member and welded to the sides of the center sill, said horizontal plate member having a slot therein defining a large width rear portion and a small width front portion, said large width rear portion defining opposed rear and front surfaces to receive the end collar of said piston rod therebetween, said vertical plate member being engaged by the cylinder at the full buff position to provide an over-solid buff stop, the rear face of the end collar of the piston rod engaging said opposed rear surface during buff travel to provide a rear buff stop and the front face of the end collar of the piston rod engaging said opposed front surface during draft travel to provide a rear draft stop.

4. In a railway car as set forth in claim 3, the sides of said center sill having elongate slots therein adjacent the horizontal plate member and being welded to the horizontal plate member at said elongate slots.

* * * * *